US011147324B2

(12) United States Patent
Dye

(10) Patent No.: US 11,147,324 B2
(45) Date of Patent: Oct. 19, 2021

(54) GARMENT CONVERTIBLE TO BABY BLANKET

(71) Applicant: Ryan E. Dye, Rigby, ID (US)

(72) Inventor: Ryan E. Dye, Rigby, ID (US)

( * ) Notice: Subject to any disclaimer, the term of this patent is extended or adjusted under 35 U.S.C. 154(b) by 0 days.

(21) Appl. No.: 16/533,646

(22) Filed: Aug. 6, 2019

(65) Prior Publication Data

US 2020/0046048 A1 Feb. 13, 2020

Related U.S. Application Data

(60) Provisional application No. 62/715,768, filed on Aug. 7, 2018.

(51) Int. Cl.
*A41D 15/04* (2006.01)
*A41B 1/08* (2006.01)

(52) U.S. Cl.
CPC ..... *A41D 15/04* (2013.01); *A41B 1/08* (2013.01)

(58) Field of Classification Search
CPC ..... A41D 1/21; A41D 10/00; A41D 15/005; A41D 15/04; A41D 27/02; A41D 27/04; A41D 2400/44; A41B 13/00; A41B 13/06; A41B 2400/36; A41B 2300/20; A47H 9/0223; A47H 9/08; A47H 9/083; A47H 9/1045; A45F 4/12
See application file for complete search history.

(56) References Cited

U.S. PATENT DOCUMENTS 2,227,751 A * 1/1941 Idelman ..... A41B 13/06 2/69.5
2,302,844 A 11/1942 Ebbott
2,670,470 A 3/1954 Manheim et al.
2,677,131 A 5/1954 Shuster
2,890,460 A * 6/1959 Daisy ..... A41D 15/005 2/144
4,700,409 A * 10/1987 De Lott ..... A45F 4/12 2/102
4,752,971 A * 6/1988 Meserol ..... A41D 3/08 2/84
4,995,115 A 2/1991 Ellis
5,042,090 A 8/1991 Cook
(Continued)

FOREIGN PATENT DOCUMENTS

CA 2880619 A1 * 5/2016 ..... A47D 15/02

*Primary Examiner* — Khoa D Huynh
*Assistant Examiner* — Grace Huang
(74) *Attorney, Agent, or Firm* — Pedersen and Company, PLLC; Ken J. Pedersen; Barbara S. Pedersen

(57) ABSTRACT

A mother's garment is adapted to effectively absorb her body scent, and also adapted to conveniently and safely convert to a baby's in-crib blanket. This way, the mother's body scent is safely made available to an infant to soothe and comfort the infant during the use of the garment as a baby blanket. Preferably, the woman's garment is a nightgown, with an added/separate fabric scent-absorbing panel secured to an interior surface of the nightgown. To deploy the nightgown safely as a baby's blanket, preferably the nightgown is turned inside out to effectively expose the scent-absorbing fabric panel directly to the infant. In addition, apertures or openings of the nightgown, like arm-holes and head/neck collar openings, are closed-up or securely tucked-away during deployment into the blanket configuration to prevent risk of strangulation or suffocation of the infant.

5 Claims, 10 Drawing Sheets

(56) References Cited

U.S. PATENT DOCUMENTS

| | | | | |
|---|---|---|---|---|
| 5,131,096 | A | 7/1992 | Olson | |
| 5,423,711 | A | 6/1995 | Dorland | |
| 6,247,178 | B1 | 6/2001 | Bilda | |
| 6,330,720 | B1 * | 12/2001 | Steelman | A41D 15/04 2/102 |
| 6,626,536 | B2 | 9/2003 | Mesplay | |
| 7,380,941 | B1 | 6/2008 | Alexander | |
| 7,419,263 | B1 | 9/2008 | Pearce et al. | |
| 7,441,281 | B2 * | 10/2008 | Salem | A41D 15/005 2/115 |
| 8,869,325 | B2 * | 10/2014 | Ng | A47G 9/0223 5/486 |
| 2013/0254968 | A1 * | 10/2013 | Gregory | A41D 15/005 2/69 |

* cited by examiner

GARMENT CONVERTIBLE TO BABY BLANKET

This application claims benefit of Provisional Application Ser. No. 62/715,768, filed Aug. 7, 2018, entitled "Garment Convertible To Baby Blanket", the entire disclosure of which is incorporated herein by this reference.

BACKGROUND OF THE DISCLOSED TECHNOLOGY

Field of the Disclosed Technology

This invention relates generally to garments, and more specifically to garments for women with baby children. For example, this invention relates to a mother's nightgown or nightshirt that effectively absorbs her body scent, and conveniently and safely converts to a baby's in-crib blanket.

This way, a mother's scent may be effectively infused into the nightgown, and the nightgown safely made into an in-crib blanket to soothe and comfort the baby.

Related Art

U.S. Pat. No. 2,302,844 Ebbott discloses a blanket which is convertible to a poncho-style garment. The poncho has an opening near its center for permitting the head of the wearer to extend through the opening. The central opening is disguised as a decorative feature of the blanket.

U.S. Pat. No. 5,423,711 Dorland discloses scent-absorbing pads for close association with a garment. Scented pads from the garment are movable from the garment to pockets in a baby's mattress or carrier.

U.S. Pat. No. 6,247,178 Bilda discloses a scent-absorbing garment, a separable sleeve portion of which is convertible to become a baby's blanket.

U.S. Pat. No. 7,380,941 Alexander discloses a scent-absorbing fabric of contrasting colors for transferring a mother's absorbed scent to surrounded articles, like baby bottles, for example, in an infant's environment, and for assisting in training the infant's visual acuity.

U.S. Pat. No. 7,419,263 Pearce et al discloses the scent-absorbing fabric of the Alexander patent above, except the mother's scent is transferred to pockets for the scent-absorbing fabric in the walls of a crib or bassinette.

SUMMARY

The present invention relates generally to a garment which is adapted to effectively absorb the body scent of a mother or other baby/child caretaker, and adapted to conveniently and safely convert to a baby's in-crib blanket. This way, the mother's body scent is safely made available to an infant to soothe and comfort the infant during the use of the garment as a baby blanket.

Preferably, the garment is a nightgown, such as a woman's nightgown. Preferably, the nightgown has a separate fabric scent-absorbing panel secured to an interior surface of the nightgown. This way, the scent-absorbing fabric may be in intimate and sustained contact with the mother's body, and effectively absorb the mother's body scent.

To deploy the nightgown safely as a baby's blanket, preferably the nightgown is turned inside out to effectively expose the scent-absorbing fabric panel directly to the infant. In addition, any aperture or opening of the nightgown, like arm-holes and head/neck collar openings, are closed-up or securely tucked-away to prevent risk of strangulation or suffocation of the infant.

One way to effectively tuck-away the apertures or openings of the nightgown is to provide an opening between an interior surface of the nightgown and an interior surface of the scent-absorbing fabric, these mutual interior surfaces being otherwise secured together. This way, the portions of the nightgown with the arm-holes and head/neck collar openings may safely be contained within the opening/space between these two interior surfaces. This way, when deployed as a blanket, the arms and neck, and the arm-holes and head/neck collar opening, are inside the blanket, and effectively kept away from, and inaccessible to, the baby.

DETAILED DESCRIPTION OF AN EMBODIMENT

Figure 1:
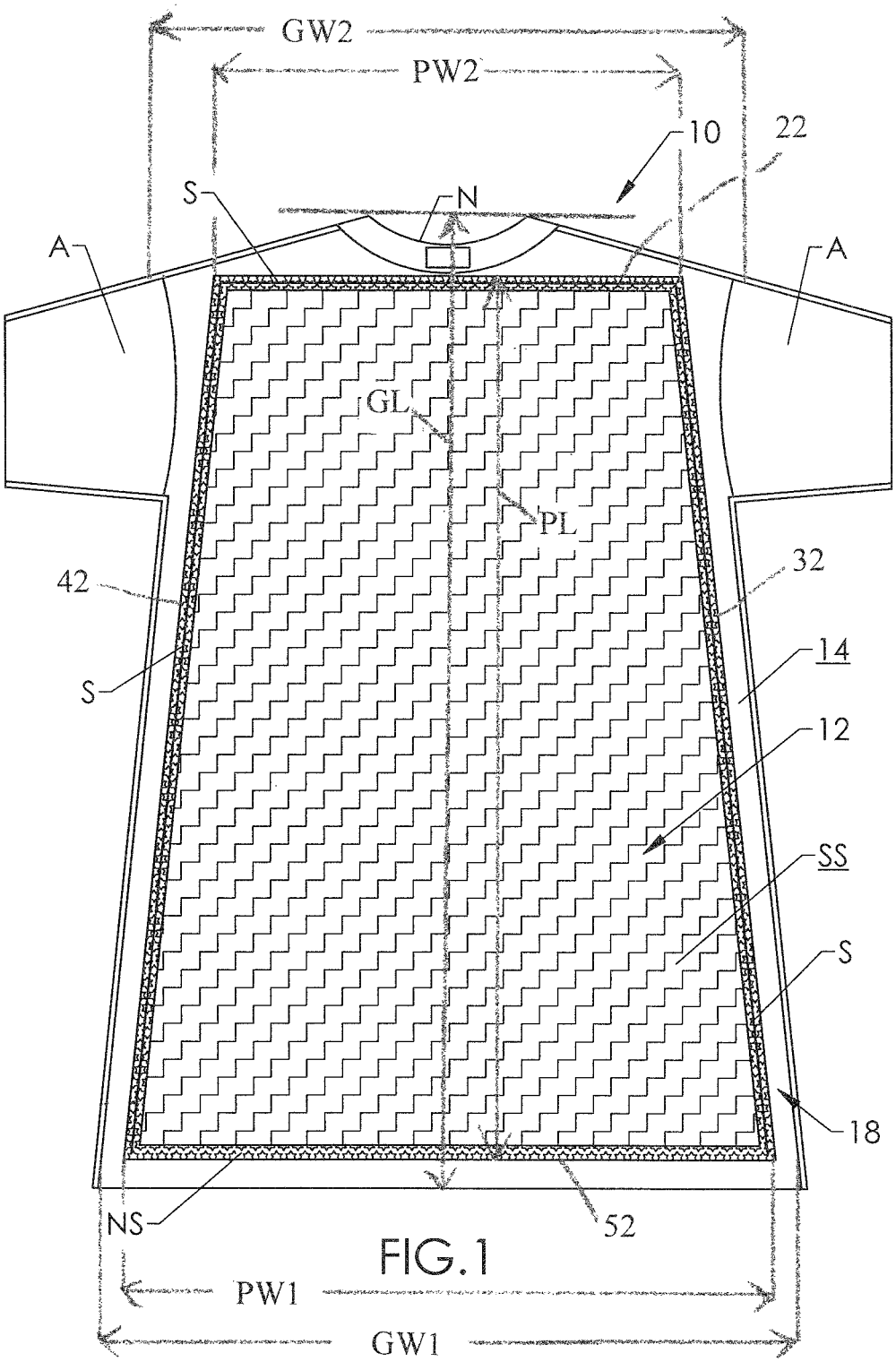
FIG. 1 is a view of the inside back of a woman's nightgown that is turned inside-out by a first method, and the inside surface of a panel of scent-absorbing fabric sewn on three sides to the inside surface of the back of the nightgown.

Referring to the Figures, there is depicted one, but not the only, embodiment of the convertible garment 10, in this case a convertible woman's nightgown 10, of the present invention. The term "garment" may be any clothing item, typically a shirt, top, dress, or gown, worn in close contact with the wearer to an extent that the wearer's scent is transferred to at least part of the garment. The term "nightgown" is a garment that is a sleeping gown, a night-shirt, pajama top, or other garment that is worn by a mother while sleeping or lounging.

The exemplary convertible garment 10 has multiple panels each comprising two surfaces, with the panels being joined/connected in this embodiment at various seams. The seams are given the letter label "S", with the understanding that the seams are preferably sewn seams, but in certain embodiments may be other forms/methods of connection. The various panels and surfaces are numbered in the drawings, but are also provided with letter labels to help the reader understand the purposes of the surfaces in the garment configuration and in the blanket configuration. Therefore, for this description, and this set of drawings:

1. "S" stands for each of the three (3) sewn seams used to attach the scent-absorbing fabric to the top, left side and right side inside of the back of nightgown 10;
2. "NS" stands for "no seam", as shown on the bottom edge of the scent-absorbing fabric where it is left open (unconnected to the back of the nightgown 10) to allow open interior space for turning-inside-out of the garment/nightgown to expose the scent panel 12 to the outside of the blanket and to capture/contain the arms and neck of the garment/nightgown inside the blanket;
3. "SS" stands for the "scent side", or the inside surface, of the scent-absorbing fabric. It is depicted in FIGS. 1, 2, 4 and 5 with a zig zag pattern; and,
4. "BB" stands for the "baby blanket" side, or the outside surface, of the scent-absorbing fabric. It is depicted in FIGS. 3 and 6-9 with a star pattern. Once the nightgown is turned inside out and tucked into the opening/space between the outside of the scent-absorbing fabric and the inside back of the nightgown, the "BB" side will be on an outside surface of the converted nightgown (see blanket 10').

Figure 4:
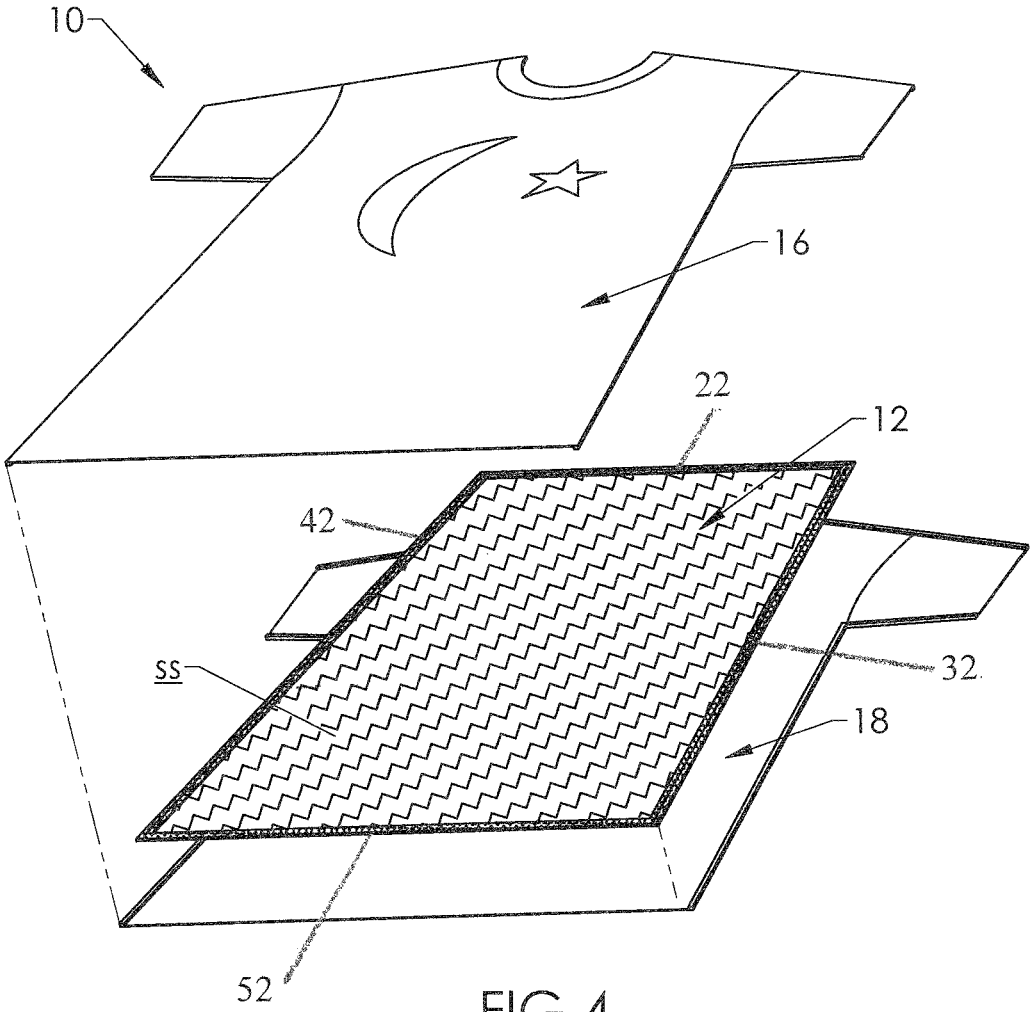
FIG. 4 is a front exploded perspective view of the nightgown depicted in FIGS. 1-3, showing the front of the gown, the inside surface of the scent-absorbing fabric, and the inside surface of the back of the gown.

FIG. 1 shows the inside back of a woman's nightgown 10, due to the nightgown 10 being turned inside-out through a first opening at the bottom end of the nightgown, so that the scent-absorbing fabric panel 12 lying against the back half 18 of the nightgown 10, with the inside surface of panel 12 (the "scent side" SS of the panel) visible. The panel 12 may be of various materials, with the preferred panel 12 being fabric that is soft to the touch and that absorbs the person's scent during contact over several hours, for example, a soft cotton material. Although the nightgown 10 is not typically worn or used in the configuration of FIG. 1, the configuration of the nightgown 10 in FIG. 1 is useful to understand the structure and construction of the nightgown 10. The outer perimeter of the panel 12 includes top outer edge 22, right outer edge 32, left outer edge 42 and bottom outer edge 52 (FIGS. 1 and 4), and the panel has panel length PL between the top outer edge 22 and the bottom outer edge 52 and panel width (PW1, PW2) between the right outer edge 32 and the left outer edge 42 (FIGS. 1 and 4). FIG. 1 illustrates to best advantage that the panel length PL is smaller than the garment length GL, and the panel width is smaller all along the panel's length than the garment width in corresponding regions, for example, the maximum panel width PW1 is in the torso region at the bottom outer edge 52 and is smaller than the garment width GW1 in the corresponding torso region, and the minimum panel width PW2 is at the top outer edge 22 in the sleeve and neck region and is smaller than the garment width GW2 in the corresponding sleeve and neck region.

Panel 12 is sewn on three sides; that is, the top, right side and left side by folded-over seams S, to the inside surface 14 of the back of nightgown 10. Panel 12 is preferably not sewn to the front half 16. Therefore, turning the nightgown 10 inside-out to place it in the configuration of FIG. 1 may be describing as turning the nightgown 10 inside-out via the first opening (see opening 100 in FIGS. 5 and 6), which is between the panel 12 and the front half 16.

At the bottom of panel 12, at "no seam" NS, is another opening referred to herein as a "second opening" (opening/space 200, see FIGS. 5 and 6) between the inside surface 14 of the back (back half) 18 of nightgown 10, and the "baby blanket" side BB of scent-absorbing fabric panel 12. A small amount of BB (starred-pattern fabric) shows in FIG. 1 because it is part of the folded-over seam S.

Figure 2:
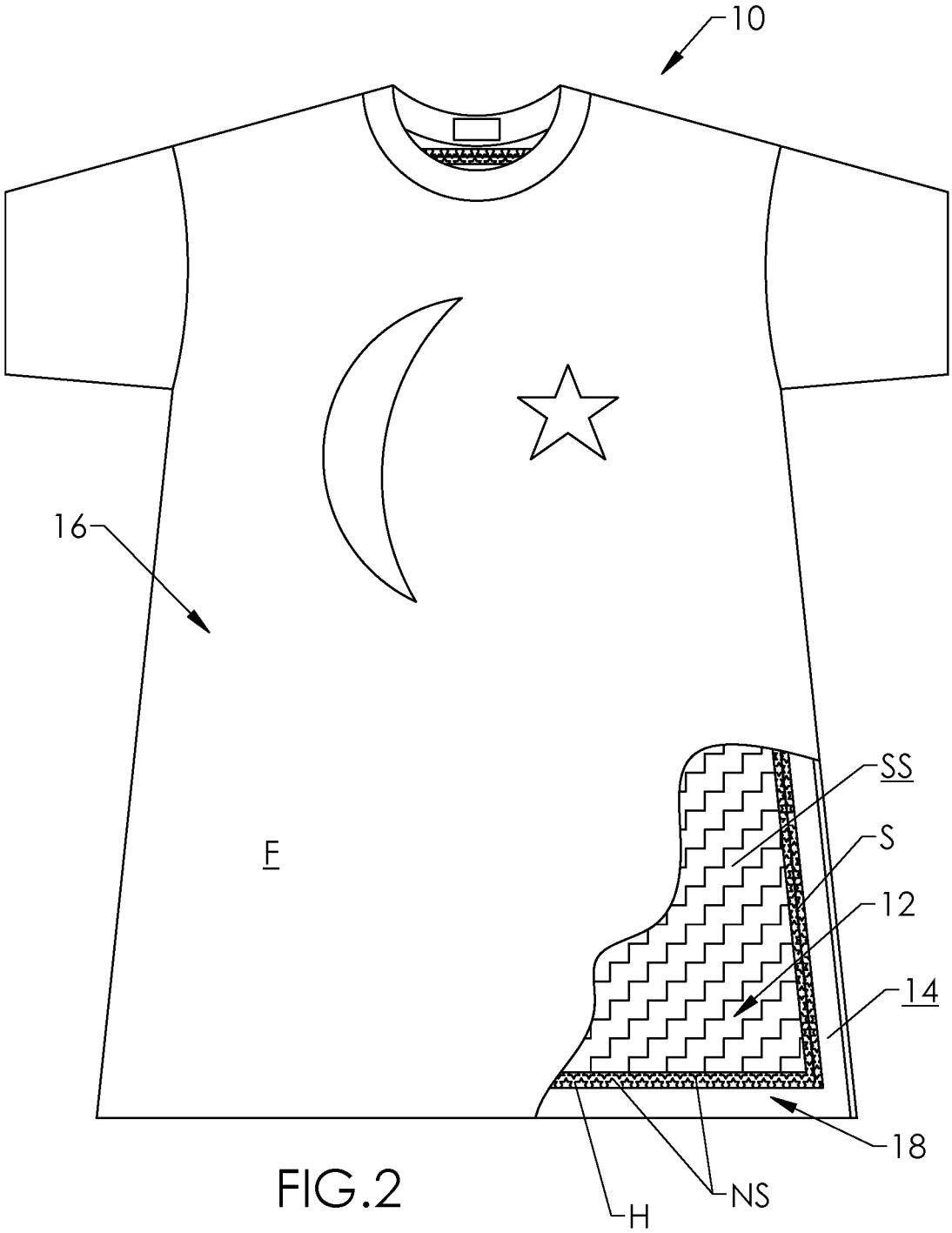
FIG. 2 is a front, partially cut-away view of the nightgown depicted in FIG. 1, but turned right-side-out, revealing in the cut-away area (by cutting-away of a portion of the front half of the nightgown) a portion of the inside surface of the panel of scent-absorbing fabric sewn to the inside surface of the back of the nightgown.

In FIG. 2, the nightgown 10 is turned right-side out as it would be in use as a nightgown ("the nightgown configuration"), and the front of woman's nightgown 10 (mainly the front half 16 of the nightgown 10 and especially the front surface F of the front half 16) is visible. In the lower right of this Figure, a piece of the front half 16 is cut-away to reveal a portion of the "scent side" SS, the inside surface of the scent-absorbing panel 12, wherein the panel 12 is sewn/connected at seams S, but not sewn at NS, to the inside surface 14 of the back half 18 of nightgown 10. A small amount of BB (star-pattern fabric) shows in FIG. 2 because it is folded-over for side seam S, and also folded over for the hem H that is provided to finish the bottom edge of panel 12 in a neat, attractive manner but that is not seamed NS or otherwise fixe/connected to the inside surface 14 of back half 18.

Figure 3:
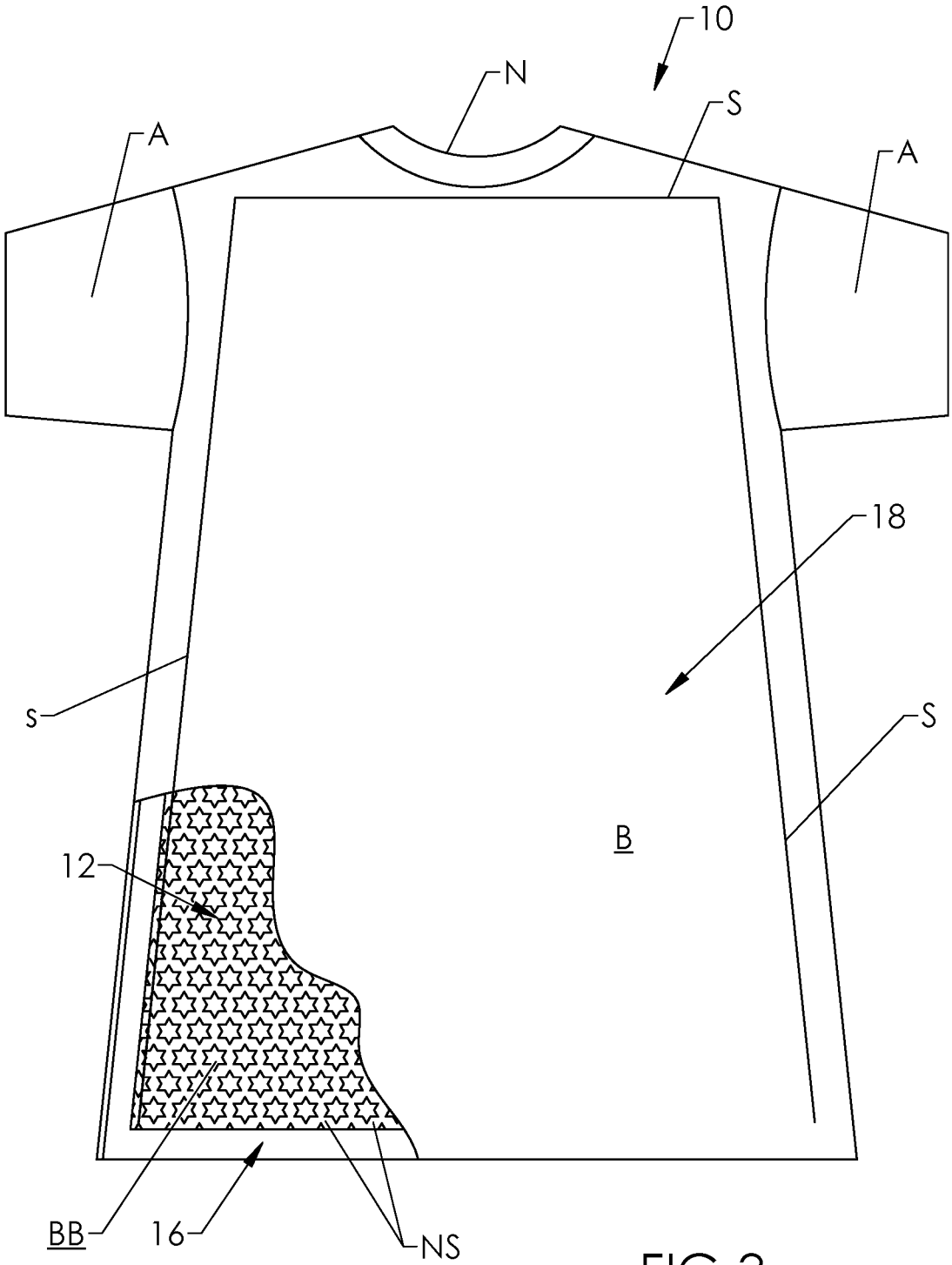
FIG. 3 is a back, partially cut-away view of the nightgown depicted in FIG. 2, revealing in the cut-away area (by cutting-away of a portion of the back half of the nightgown) a portion of the outside surface of the panel of scent-absorbing fabric and a portion of the front half of the nightgown.

In FIG. 3, the back of woman's nightgown 10 is shown, when the nightgown 10 is turned right-side out in the nightgown configuration, so that mainly the back surface B of the back half 18 is visible. In the cut-away section in the lower left of this Figure, a portion of the "baby blanket" side BB, or the outside surface of scent-absorbing panel 12, is visible. Seam S is visible in this figure because the stitching extends through the back half 18 of nightgown 10. The "baby blanket" side BB, the outside surface of the scent-absorbing panel 12, is shown sewn at seam S, but not sewn NS at its bottom hem/edge, to the inside surface 14 of the back of nightgown 10.

In FIG. 3, one may note that the seams S extend in generally a U-shape, along three sides of generally a rectangle. Specifically, the seams S extend transversely between the shoulders just below the neck N, and longitudinally along the right and left sides of the nightgown 10 slightly inside of the arms A. Alternative embodiments may have the right and left seams S being the same seams that connect the front half 16 and back half 18 together along the right and left edges of the torso portions of front and back halves 16, 18; even in such embodiments, the seams should extend up nearly to the shoulders inside of the arms A. Such seam S placement (that shown in the Figures or as described as alternative embodiments in this paragraph) is important because, when the nightgown 10 is turned inside-out through the second opening 200 (FIGS. 5 and 6), to become configured as a blanket 10' as further described below, all of the arms A, neck N, and their respective openings, are contained inside the blanket 10'. See dashed lines in FIGS. 10 and 11. The locations of the seams S causes the blanket 10' to have a generally rectangular exterior perimeter shape, that is, generally or exactly the shape of the seams S shape plus the bottom edges of the front half 16, back half 18, and panel 12 forming the fourth side of the blanket 10'. See FIGS. 7-11.

In FIG. 4, nightgown 10 is shown, in an exploded view, separated apart into its front half 16 and its back half 18. Between the front and back halves 16, 18 is the scent-absorbing panel 12, with its "scent side" SS surface facing upward in this view. As will be understood from the description above and the other Figures, during wearing of the nightgown, the mother's back preferably will be directly in front of the scent side SS (between the front half 16 and the scent side SS), so that the mother's scent is infused into scent side SS, and hence, preferably into the entire scent-absorbing panel 12.

Figure 5:
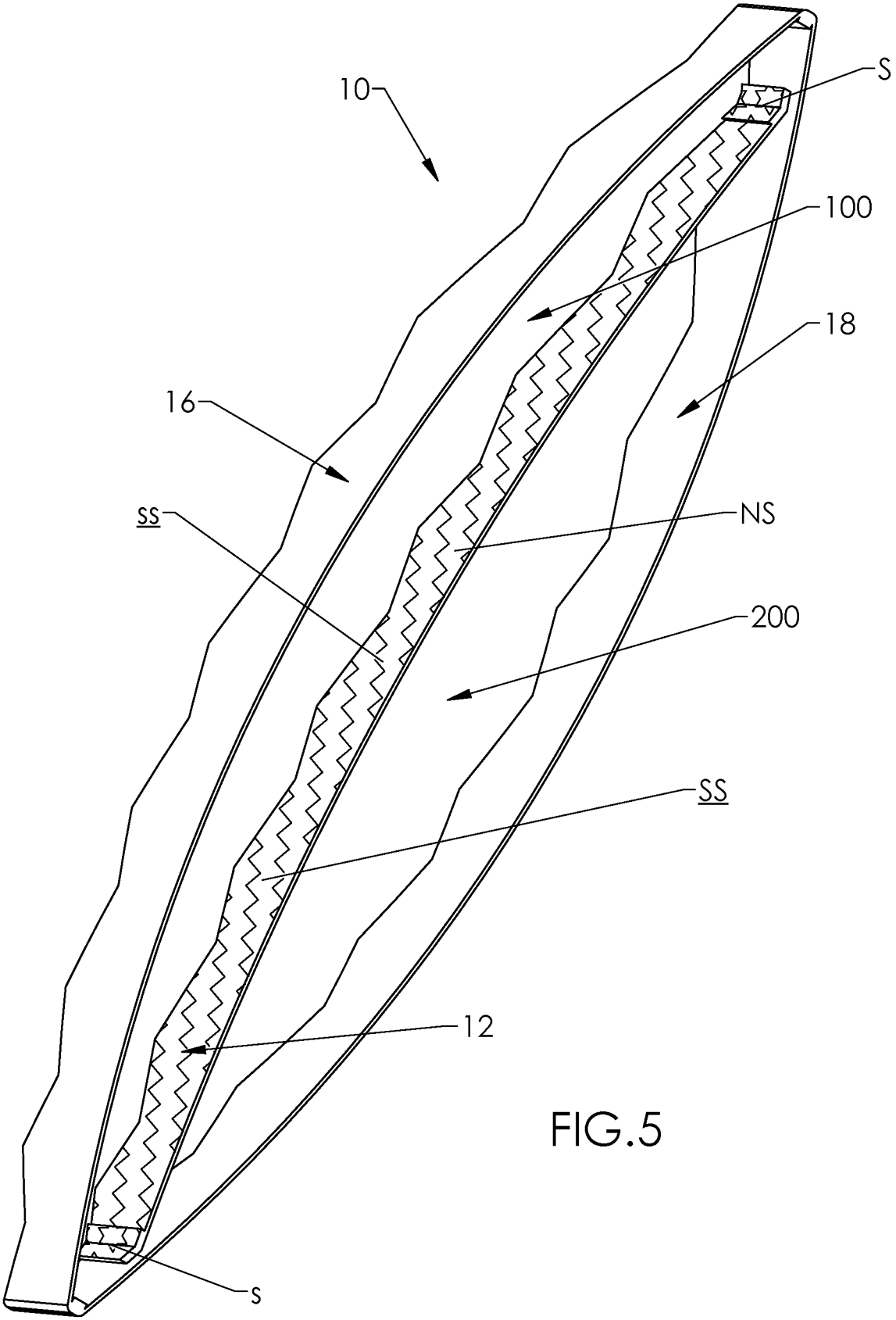
FIG. 5 is a front side, perspective cut-through view of the bottom/bottom-edge region/portion of the gown depicted in FIGS. 1-4, showing a portion of the front (or "front half") of the gown, an opening (a "first opening") between the front half of the gown and the inside surface of the panel of scent-absorbing fabric, and an opening (a "second opening") between the outside surface of the scent-absorbing fabric and the back (or "back half") of the gown.

In FIG. 5, a cut-through bottom section of nightgown 10, from the front to the back thereof, shows to best advantage the two openings/interior-spaces 100, 200 at/near the bottom end of the nightgown 10. First opening 100 exists between the front half 16 of nightgown 10, and the "scent side" SS of scent-absorbing panel 12. This opening 100 is for receiving the body of the mother when she wears nightgown 10, infusing "scent side" SS with her body scent. It is through this opening 100 that the nightgown may be turned in-side out to place the nightgown 10 in the orientation/condition of FIG. 1, if desired.

Because the bottom edge of panel 12 is not fixed/sewn to the back half 18, a second opening 200 in FIG. 5 exists between the back half 18 of nightgown 10 and the panel 12, specifically between the back half 18 and the "baby blanket" side BB (or BB surface) of scent-absorbing panel 12. This opening/interior-space 200 is for turning the nightgown 10 inside-out so that the arms A and the neck N, and the front half 16 all lie between the panel 12 and the back half 18, transforming the nightgown 10 into the blanket configuration 10' and exposing the "baby blanket" side BB (or BB surface) of scent-absorbing panel 12. This way, the "baby blanket" BB side of scent-absorbing panel 12 of nightgown 10 is made available as an in-crib baby blanket, and the infused scent of the mother is available and sensed by the baby lying on the blanket 10' due to the mother's scent being close to the baby, for example, by being on the SS side that is very near to the baby or by the scent having permeated from the SS side through the panel 12 and into the baby blanket side BB.

Figure 6:
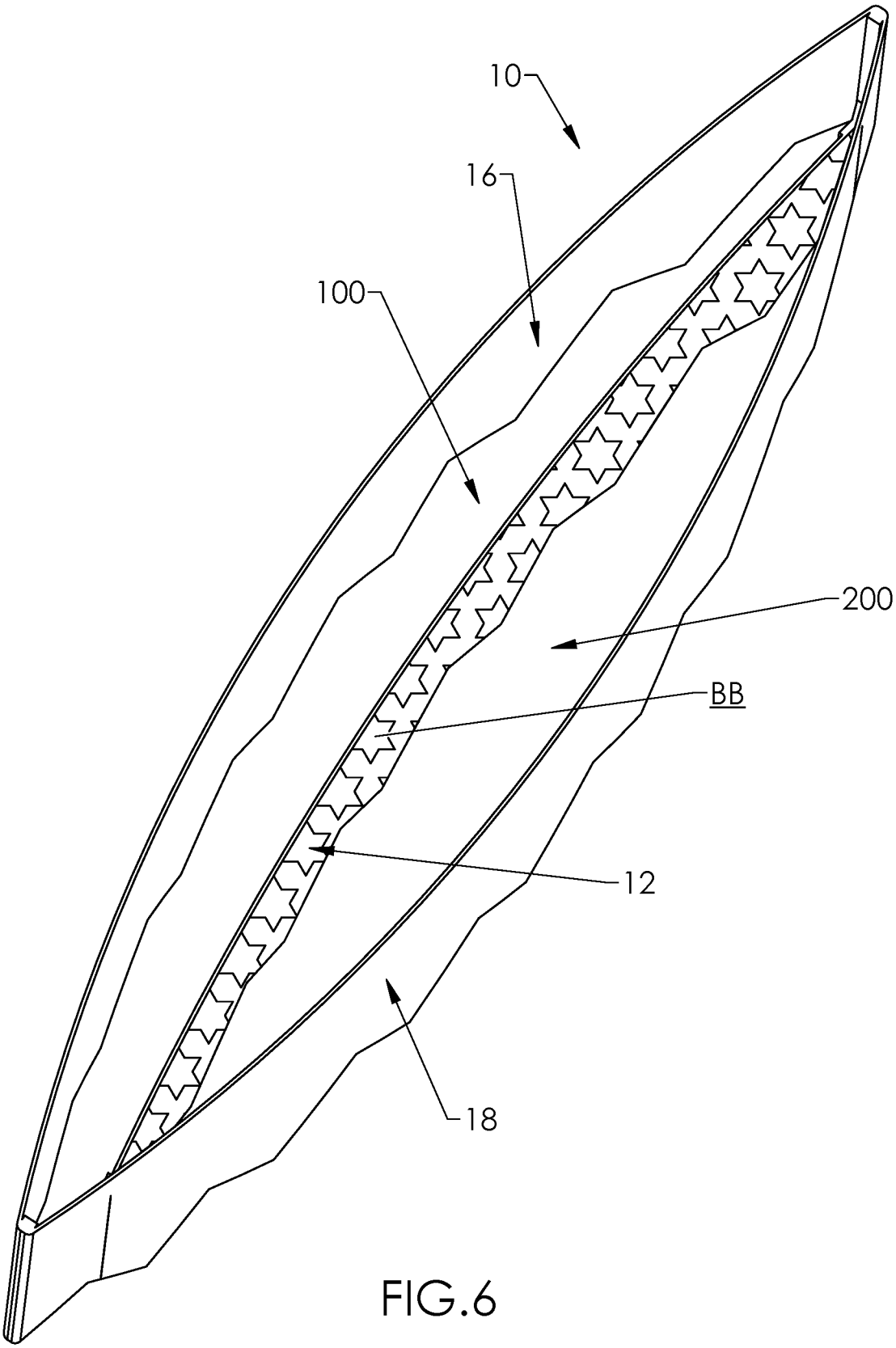
FIG. 6 is a rear side, perspective view of the gown region/portion that is shown in FIG. 5, showing the outside surface of the panel of scent-absorbing fabric between the front (or "front half" of the gown and the back (or "back half") of the gown.
Figure 7:
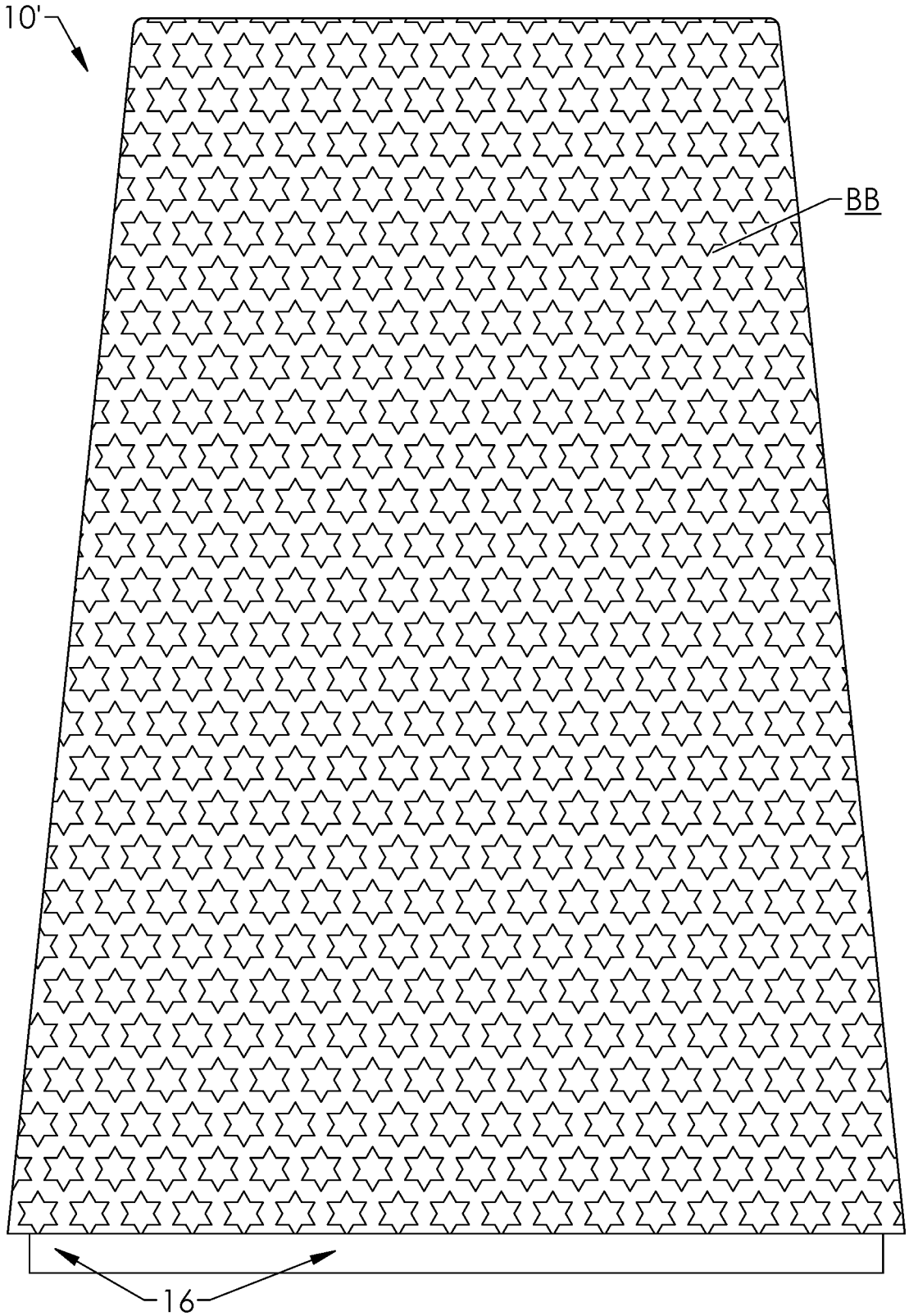
FIG. 7 is a top ("blanket-top") perspective view of the nightgown of FIGS. 1-6, converted into a crib blanket configuration by turning the nightgown inside-out through said second opening shown in FIGS. 5 and 6, so that the outside surface of the panel of scent-absorbing fabric is now on the top exterior of the crib blanket for contact by a baby/child, wherein a bottom edge of the front half is visible in FIG. 6 because the front half and back half of the nightgown hang down slightly below the panel of scent-absorbing fabric in FIG. 7.
Figure 8:
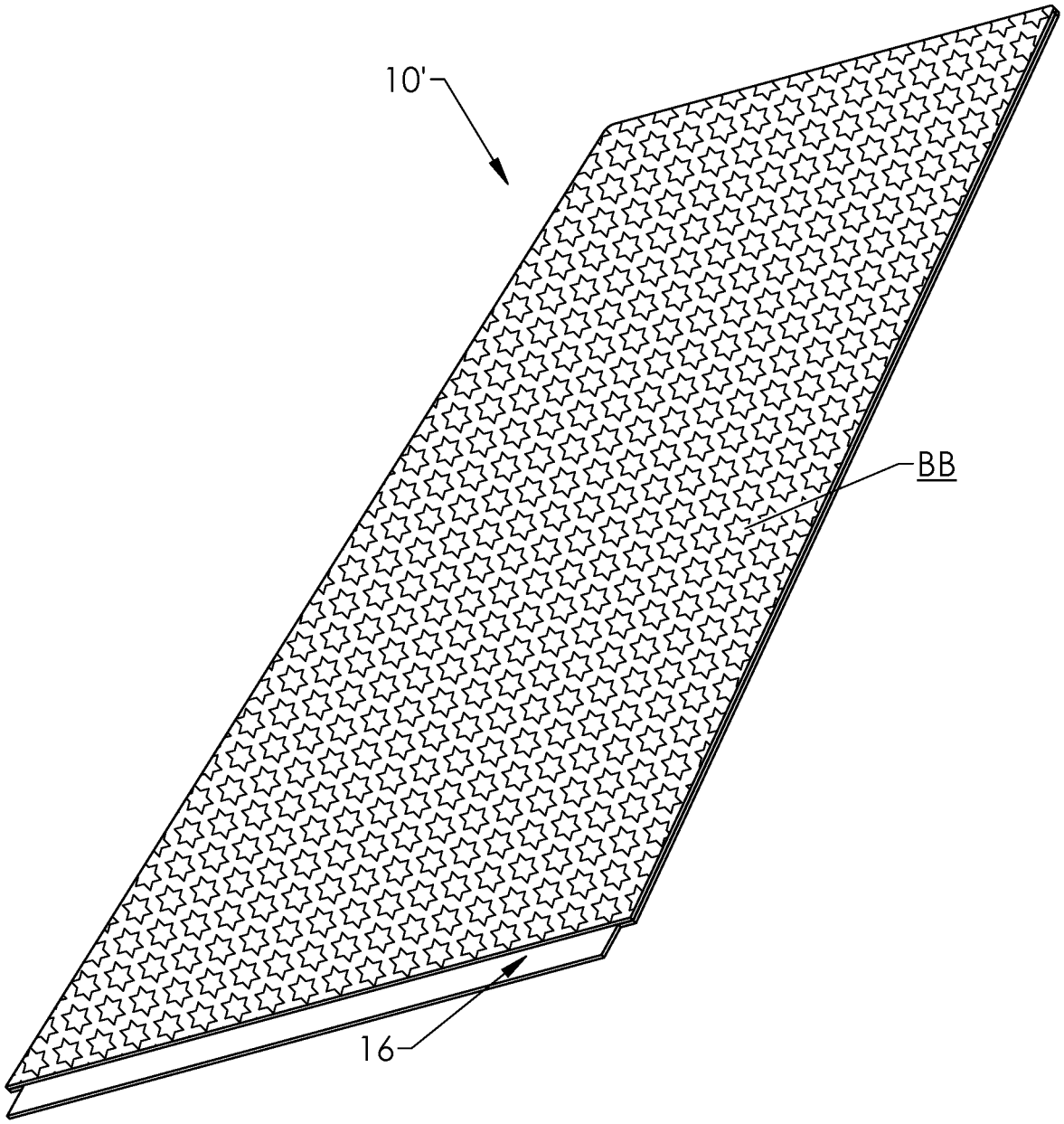
FIG. 8 is a bottom right-side perspective view of the crib blanket depicted in FIG. 7.
Figure 9:
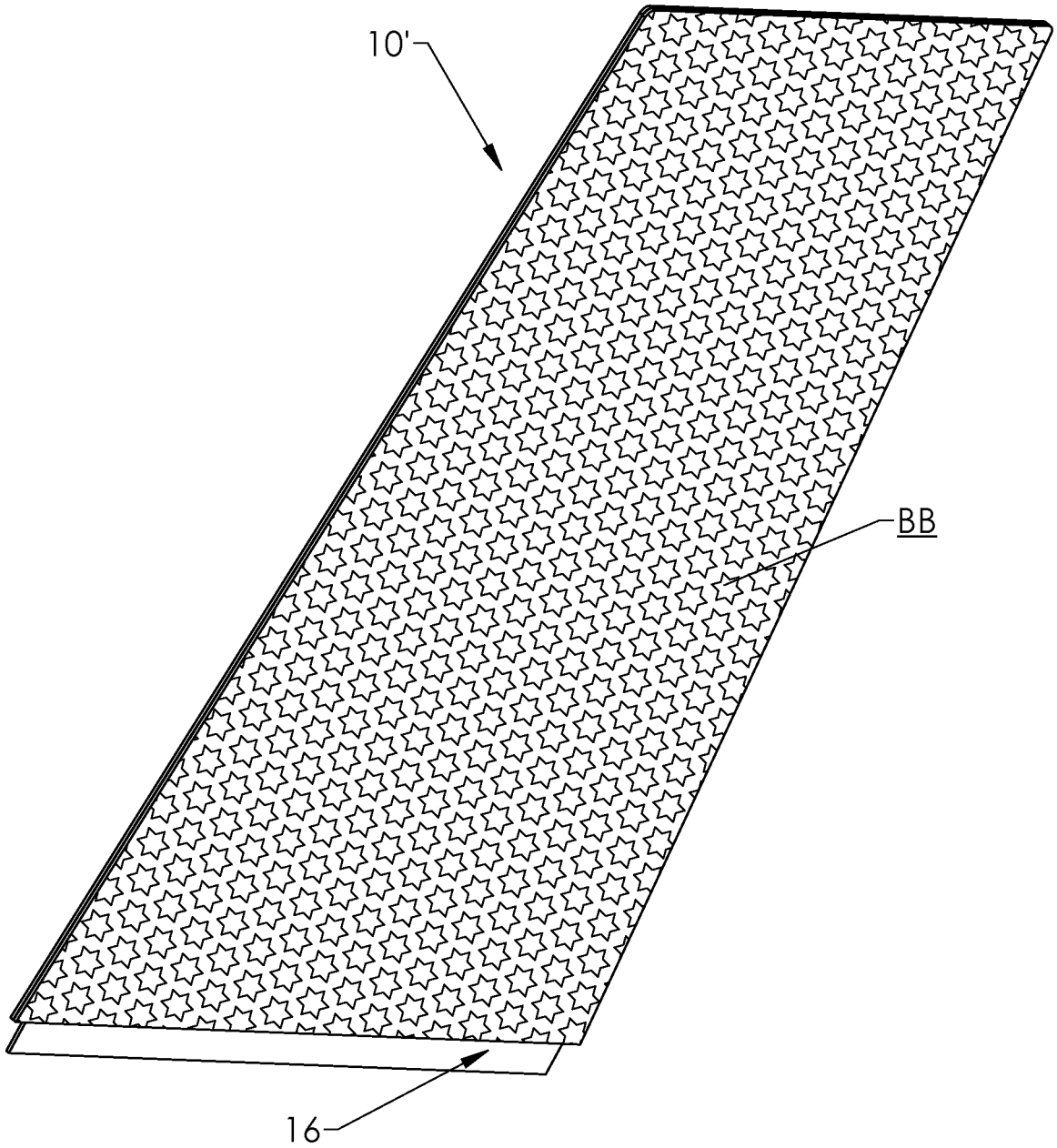
FIG. 9 is a blanket-top left-side perspective view of the crib blanket of FIGS. 7 and 8.

FIG. 6, like FIG. 5, is a cut-through bottom section of nightgown 10, but viewed from the back to the front, showing again the two openings/interior-spaces 100, 200 at/near the bottom end of the nightgown 10. In other words, FIG. 6 is like FIG. 5, but is rotated toward the left of the sheet relative to FIG. 5. As in FIG. 5, first opening 100 exists between the front half 16 of nightgown 10, which is where the wearer's body/torso is received to infuse/impart scent to the "scent side" SS of scent-absorbing panel 12. As in FIG. 5, second opening 200 exists between the back half 18 of nightgown 10 and the panel 12, for turning the nightgown 10 inside-out so that the arms A and the neck N, and the front half 16 all lie between the panel 12 and the back half 18 blanket configuration 10' that exposes the "baby blanket" side BB (or BB surface) of scent-absorbing panel 12, as described above.

Figure 10:
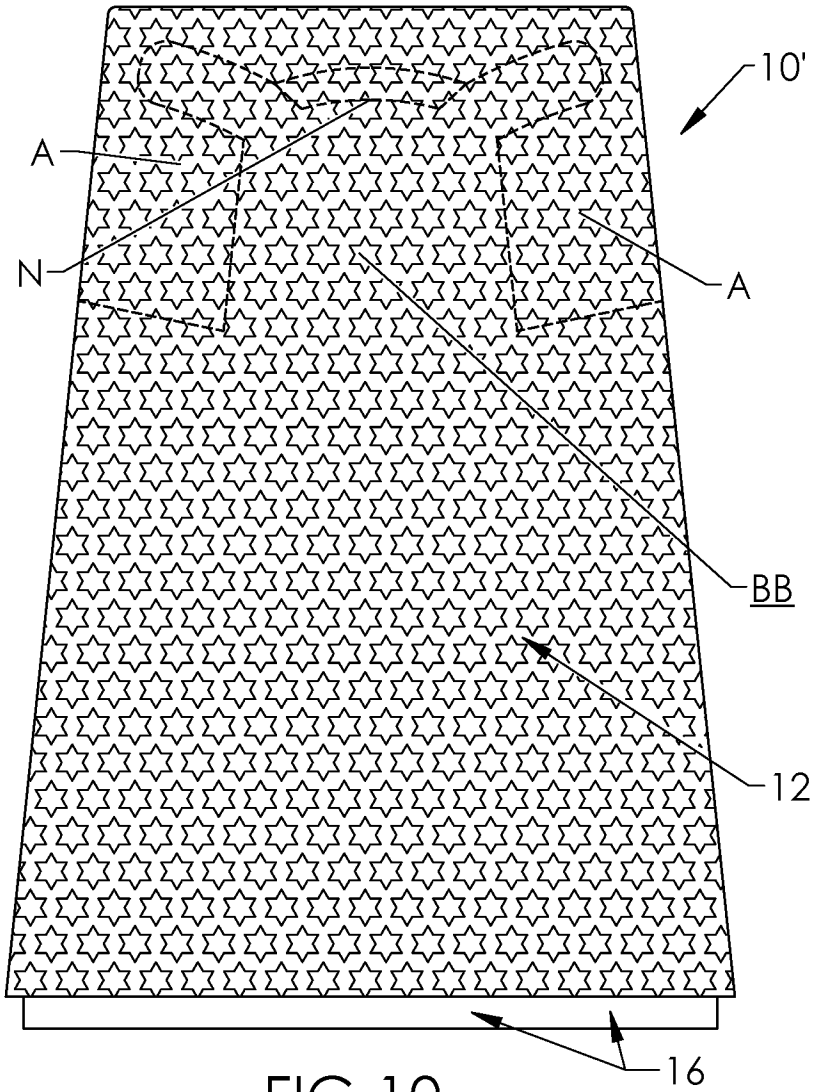
FIG. 10 is a blanket-top view of the crib blanket of FIGS. 7-9, with dashed lines illustrating that, in the blanket configuration, the arms and neck are inside the blanket near one end of the blanket opposite the bottom opening of the blanket where the hemmed, but not seamed/connected edge of the scent-absorbing fabric panel is located.

In FIGS. 7-10, the nightgown has been transformed into the blanket configuration 10', as discussed above, by having been turned inside-out, via opening 200, so that the BB surface that covers most of the top of the blanket 10' is mainly visible in these blanket-top-side views. In the blanket configuration views of FIGS. 7-9, one may described the BB surface being the blanket-top-side, the edge of the blanket 10' near the top of the sheets being the blanket-top-end, the edge of the blanket 10' near the right edge of the sheets being the blanket-right-side or blanket-right-edge, and the edge of the blanket 10' near the left edge of the sheets being the blanket-left-side or blanket-left-edge. In the view of FIG. 10, the viewer may be said to be viewing the top-side of the blanket 10'. These terms are used to differentiate from the simpler terminology used for the garment as-worn configuration, for example, in FIGS. 2 and 3, the neck end near the top of the sheets may be called the garment's top end, the opposite end near the bottom of the sheets may be called the garment's bottom end or bottom edge, the side near the right edge of the sheets may be called the garment's right side and the side near the left edge of the sheets may be called the garment's left side.

Thus, the nightgown 10 is converted into in-crib blanket 10', with the whole assembly/device turned inside out, and the rest of nightgown 10 (arms A, neck N, and panel 16), except the BB side of scent-absorbing panel 12, in effect stuffed into the opening 200 between the back 18 of nightgown 10 and panel 12. In this configuration and view, panel 12 lies against the front half 16, and the front half 16 lies against the back half 18, wherein back half 18 is not visible in FIGS. 7-9, but is understood to be behind the front half 16 in FIGS. 7-9. A small piece/bottom-edge of front half 16 is visible at the bottom of FIGS. 7-9, because it, and typically back half 18 behind it, are slightly longer than the BB side of scent-absorbing panel 12.

Figure 11:
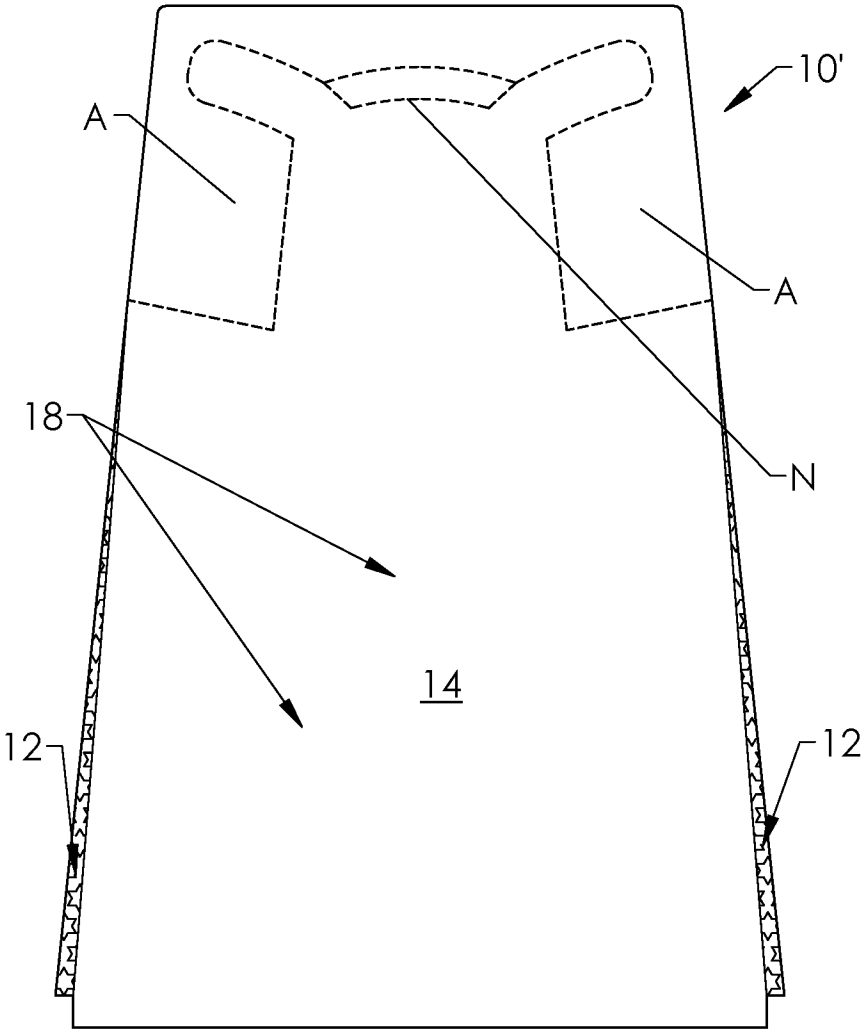
FIG. 11 is a blanket-bottom view of the crib blanket of FIGS. 7-10, where the dashed lines again, as in FIG. 10, shown the arms and neck contained within the blanket.

FIGS. 10 and 11 illustrate the blanket 10' in a blanket-top view (FIG. 10), and a blanket-bottom view (FIG. 11), and schematically portray the arms A and neck N in dashed lines to indicate that the arms A and neck N, along with most or all of the front half/panel 16, are contained inside the blanket 10', that is, between the of scent-absorbing panel 12 and the back half 18. The arms A and neck N and adjacent portions of the front half 16 may be crumbled or folded slightly inside the interior space of the blanket 10', for example, but their specific orientation and their flatness inside said interior space, is typically not critical, as they are entirely or at least substantially soft fabric that will not make the blanket 10' uncomfortable for the baby/child to lie upon. Importantly, the arms A and neck N are inside the blanket interior space that resides between panel 12 and back half 18, and distanced from the openings at the bottom of the blanket 10', so the baby/child will typically not be able to reach or access the arms A or neck N, or their respective arm holes or neck hole.

Therefore, in the blanket configuration 10', the "baby blanket" side BB (or BB surface) of scent-absorbing panel 12 and the inside surface 14 of the back half 18 face outward, and the entire front half 16, arms A, and neck N lie inside the blanket 10' between the "scent side" SS of panel 12 and the back surface B of the back half 18. Note that said inside surface 14 is not visible in the top and top perspective (blanket-top) views of FIGS. 7-10, but surface 14 is visible in FIG. 11, as the blanket 10' in FIG. 11 is flipped generally 180 degrees over from the views of FIGS. 7-10. Thus, the nightgown 10 is turned inside-out so that the arms A and neck N, and their respective arm and neck holes, are contained/hidden inside the interior space of the blanket 10'. As these portions (arms A, neck N, and their openings) are, in effect, deep inside the blanket, specifically deep inside the interior space, they are inaccessible to the baby and the baby will not reach or contact the arms A, neck N, or their holes. Therefore, the device is made safe for use as an in-crib blanket 10'. Optionally, fastening means, such as snaps, hook and loop fastener, or other fasteners, may be used to connect the otherwise-open edges of all of panel 12, 16, and 18 (toward the bottom of the sheets in FIGS. 7-11) after the device is turned inside-out into the blanket configuration 10', to close or substantially close those openings during use of the device in the blanket configuration, to reduce or eliminate the chance of the baby/child reaching or crawling into the interior space of the blanket 10'.

To transform the as-worn configuration to the blanket configuration, a user may grasp and lift the front half 16 and the panel 12 away from back half 18, to open the opening/space 200. Then, the user may reach deep into second opening 200 (in effect, into the interior space of which opening 200 is the opening/entry) with a second hand to grasp the neck region from inside the opening/space 200. Then, the user will pull (with the second hand) the neck region forward toward the use and push (with the first hand) the bottom edge portions of the panel 12 and front half 16 backward away from the user, to turn the device inside-out "through/via opening/space 200". As this is done, the neck N, arms A, and the front half 16 will be moved to inside the blanket 10'.

The blanket configuration 10' of the device is substantially flat and has a generally rectangular outer perimeter generally corresponding to the three seams S shown in the Figures (see FIG. 3), and a fourth edge/portion that is formed by a combination of the typically unconnected edges of the panel 12, the front half 16, and the back half 18, that is, the edges of panels 12, 16, 18 that are at the bottom of the garment in its as-worn configuration. As described above, said bottom edges of the panel 12, front half 16, and back half 18 are not connected, fixed or fastened together, but, alternatively, fasteners may be used to fix/fasten these bottom edges together after the device is converted into the blanket configuration 10'.

After transformation into the blanket configuration 10', it should be noted that preferably there are no openings, no arms A, and no neck N, visible or accessible, along the left side edge, right side edge, or the end of the blanket 10' corresponding to the neck-end of the garment. This may be seen to best advantage in FIGS. 8-11, wherein the blanket left side edge, blanket right side edge, and blanket neck-end are shown with no openings, and those edges and ends are shown and understood to be entirely closed/stitched due to the seams S fixing the panel 12 to the back half 18 shown in FIGS. 1-3, for example.

Certain embodiments may be described as a garment that comprises two configurations during use, one for wearing by a mother or other adult or caretaker of a baby/child to gather/hold the scent of the mother/adult/caretaker, and one for use as a blanket or other bedding for the baby/child, wherein at least the neck and arms, and optionally all openings, are closed/blocked/covered when the garment is in the blanket configuration. Certain embodiments may be described as: a garment adapted to be worn by a person in an garment as-worn configuration on a torso of the person so that scent of the person is on at least a portion of the garment (preferably, but not necessarily exclusively, at least a provided scent panel), and the garment being adapted to be transformed by turning the garment inside-out into a blanket configuration for use by a baby or child so that the baby or child while on top of the blanket will smell or sense the scent of the person, the garment comprising: a front half and a back half connected together at right and left sides and at a top end of the garment, a neck opening at the top end of the garment, and arms and arm holes at the right and left sides of the garment; and a scent panel inserted between the front half and back half and fixed at top, right and left edges of the scent panel to an interior surface of the garment in the as-worn configuration; wherein a bottom edge of the scent panel is not connected to bottom edges of the front half and back half so that there is an opening, between the scent panel bottom edge and the back half bottom edge, that opens into and communicates with an interior space between said scent panel and the back panel; wherein, after being transformed into the blanket configuration, the garment in the blanket configuration has a blanket-top-side, a blanket-bottom-side, a blanket-right-side, a blanket-left-side, a blanket-top-end, and a blanket-bottom-end, wherein the scent panel is at the blanket-top-side so that the baby or child when on top of the blanket is on and contacting the scent panel, and the back half of the garment is at the blanket-bottom side, and wherein the front half of the garment, the neck opening, and the arm holes are inside the blanket configuration between said scent panel and said back half, so that the baby or child does not contact or access the neck opening and arm holes. In certain of the embodiments in the sentence above, the scent panel, when the garment is in the as-worn configuration, extends from near the neck opening to near the bottom edge of the back half, as well illustrated in FIG. 1, for example; the scent panel may extend longitudinally (neck opening to bottom edge) to cover 70-100 percent of the back half, and preferably 80-95 percent of the back half, for example. Further, when the garment is in the as-worn configuration, the scent panel preferably extends from near a right edge to near a left edge of the back half, as also shown in FIG. 1, for example; the scent panel may extend transversely (right edge to left edge) to cover 70-100 percent of the back half, and preferably 80-95 percent of the back half, for example. The top, right and left edges of the scent panel may be fixed to the interior surface of the as-worn configuration by various methods, but stitched seams are currently preferred, and the bottom edge of the scent panel is preferably not fixed or stitched to the front half and preferably not fixed or stitched to the back half, for allowing the transformation from the garment as-worn configuration to the blanket configuration, as described in this document. Preferably the top, right and left edges of the scent panel are fixed or stitched to the back half. The garment may be a nightgown and, in the as-worn configuration, the scent panel is in contact with skin of a back of the person wearing the garment. The garment in the blanket configuration may be generally rectangular and has no opening at the blanket-right-side, no opening at the blanket-left-side, and no opening at the blanket-top-end. The opening(s) at the blanket-bottom-end (at the bottom edges of the front half, back half, and the scent panel) optionally may be provided with fasteners that may be used so that all openings (including at said blanket-bottom-end) are temporarily closed for further safety during use of the garment as a blanket/bedding. Such fasteners would therefore be considered temporary closures, and would be opened/unfastened for transforming the garment back into the as-worn configuration.

Although this invention has been described above with reference to particular means, materials and embodiments, it is to be understood that the invention is not limited to these disclosed particulars, but extends instead to all equivalents within the scope of the following claims.

The invention claimed is:

1. A garment adapted to be worn by a person in an as-worn configuration on a torso of the person that a scent of the person is on at least a portion of the garment, and the garment being adapted to be transformed into a blanket configuration for use by a baby or child so that the baby or child will smell or sense the scent of the person, the garment comprising:

a front half of the garment and a back half of the garment connected together at right and left sides of the garment and at a top end of the garment, a neck at the top end of the garment, and arms at the right and left sides of the garment; and a scent panel having a baby-blanket-side and an opposing scent-side, an outer perimeter consisting of a top edge having a top edge width, a bottom edge having a bottom edge width, a right edge having a right edge length, and a left edge having a left edge length, wherein the top edge extends from the right edge to the left edge and intersects the right edge and the left edge, wherein said scent panel is between the front half and back half of the garment so that the baby-blanket-side of the scent panel is against an inside surface of the back half of the garment and the scent-side faces toward the front half of the garment for contacting the torso of the person wearing the garment to acquire the scent of the person, and where side top edge of the scent panel is secured along the entire top edge width to the inside surface of the back half of the garment by a top seam, and said right and left edges of the scent panel are secured along the entire right edge length and left edge length by right and left seams, respectively, to said inside surface of the back half of the garment;

wherein a garment width extends from the right side of the garment to the left side of the garment at the bottom outer edge of the garment, wherein the bottom edge width of the scent panel is smaller than the garment width of the garment;

wherein the bottom edge of the scent panel is not secured to the front half of the garment and is not secured to the back half of the garment so that there is an opening between the scent panel bottom edge and a bottom edge of the back half of the garment that opens into and communicates with an interior space between said baby-blanket-side of the scent panel and said inside surface of the back half of the garment;

wherein, after the garment is turned inside-out through said opening to be in the blanket configuration:

said baby-blanket-side of the scent panel and said inside surface of the back half of the garment face outward to be two exposed surfaces of the garment and wherein the front half of the garment, the neck and the arms are between the scent-side of the scent panel and a back side of the back half of the garment, wherein the back side is the surface of the back half of the garment opposite the inside surface, so that the baby or child does not contact the neck or arms of the garment when resting on said baby-blanket-side or on said inside surface of the back half of the garment.

2. The garment as in claim 1, wherein the top, right and left seams are stitched seams.

3. The garment as in claim 1, wherein the garment is a nightgown and, in the as-worn configuration, the scent-side of the scent panel is in contact with skin of a back of the person wearing the garment.

4. The garment as in claim 1, wherein the garment in the blanket configuration is generally rectangular.

5. The garment of claim 1, wherein the garment is selected from a group consisting of: a shirt, a top, a dress, a gown, a nightgown.

* * * * *